United States Patent [19]

Schiel

[11] Patent Number: 4,875,975

[45] Date of Patent: Oct. 24, 1989

[54] DEVICE FOR DRAWING AN ENDLESS BELT INTO A PAPER MAKING MACHINE

[75] Inventor: Christian Schiel, Heidenheim, Fed. Rep. of Germany

[73] Assignee: J. M. Voith GmbH, Fed. Rep. of Germany

[21] Appl. No.: 267,183

[22] Filed: Nov. 4, 1988

[30] Foreign Application Priority Data

Nov. 5, 1987 [DE] Fed. Rep. of Germany ..... 3737584

[51] Int. Cl.[4] ..... D21F 1/24

[52] U.S. Cl. ..... 162/273; 162/200; 162/274

[58] Field of Search ..... 162/199, 200, 272, 273, 162/274, 358, 360.1

[56] References Cited

U.S. PATENT DOCUMENTS

| | | | |
|---|---|---|---|
| 1,937,125 | 11/1933 | Pederson | 162/273 |
| 3,352,747 | 11/1967 | Lithgo et al. | 162/274 |
| 4,138,316 | 2/1979 | Kessler et al. | 162/273 |
| 4,220,501 | 9/1980 | Skaugen | 162/273 |

FOREIGN PATENT DOCUMENTS 2439261 1/1979 Fed. Rep. of Germany .

*Primary Examiner*—Karen Hastings

*Attorney, Agent, or Firm*—Ostrolenk, Faber, Gerb & Soffen

[57] ABSTRACT

A device for drawing in an endless belt into a machine which manufactures paper, cardboard, or the like, includes a frame having a draw-in side over which the belt is drawn in and having an opposite side. An auxiliary support for the belt and off which the belt is transferred is moved up to the draw-in side of the frame. The frame has at least one cantilever piece extending beyond the draw-in side toward the auxiliary support. The auxiliary support has a corresponding cantilever arm. A lift device joins the cantilever arm with a respective cantilever piece to provide lift of the cantilever piece. The frame on the draw-in side has a removable intermediate piece, removable to permit the belt to be drawn in while the cantilever arm supports the cantilever piece and thereby supports the draw-in side of the frame. With the intermediate piece reinstalled in the draw-in side of the frame, the auxiliary support may be removed. In a one-belt height arrangement, the auxiliary support is generally C-shaped. In a two-belt height arrangement, the auxiliary support is generally E-shaped. The cantilever piece may be telescopable toward the machine frame and out of it. Various additional lift devices may be provided for the belt and for the frame toward the draw-in side.

17 Claims, 4 Drawing Sheets

DEVICE FOR DRAWING AN ENDLESS BELT INTO A PAPER MAKING MACHINE

BACKGROUND OF THE INVENTION

The present invention relates to a draw-in device for drawing an endless belt, like a wire or a felt, into a paper making machine, cardboard making machine, or the like. Such a draw-in device is known from Federal Republic of Germany Pat. No. 2,439,261.

Wires or felts of paper making machines are each in the form of an endless belt which forms a belt loop. The felts or wires used are frequently rather stiff and therefore can be neither folded nor gathered. In the case of wires, gathering is not permissible since the wire would be damaged.

Such belt loops travel over rotatable cylinders, press rolls, guide rolls, or the like, along an endless path. The rolls are mounted for rotation in frame parts located on the guide side of the machine and on the opposite drive side of the machine. The rolls, which are typically part of the frame, are arranged within the belt loop. Frequently, two belt loops are arranged one above the other. This further complicates the drawing in of the belt loops. The difficulty in the drawing in occurs because the supports for the rolls, which are typically part of the frame, do not permit the axial drawing in of the belt loop over these inner rolls. In order to nevertheless apply the endless belt loop onto the inner rolls without interference, three fundamental systems have been employed in the past.

(a) The removal system:

All rolls and supports which are arranged within the belt loop, as well as any other parts which extend through the belt loop, are removed individually or jointly from the machine. After the belt loop is placed into the machine, those rolls, supports and parts are passed through the belt loop and are again fastened to the frames or foundation.

(b) The cantilever foundation:

All rolls and other parts which extend through the belt loop are clamped firmly to one of the two side frames or foundation sides. Upon removal of intermediate pieces from the side frame on the other side, these rolls and parts freely protrude to that other side and are cantilevered, which permits the belt loop to be introduced around these protruding parts from that other side. The intermediate pieces are thereafter reinserted.

(c) The push-on system:

Lengthening or extension supports are fastened to the protruding journals of the rolls or to corresponding fastening points of the frame which holds the one end of the rolls and also holds the other parts present within the belt loop. The belt loop is placed over these extension supports. As a second step, these extension supports are lifted up outside the belt loop. Intermediate pieces on the frames are removed, and the belt loop is introduced laterally into the operating position. The intermediate pieces are reinserted and the extension supports are, as a rule, then removed.

In the case of belt loops which are arranged one above the other, combinations of these systems are of course also possible in which, for instance, the lower belt loop is installed under tension in accordance with system (a) and the upper belt loop is installed in accordance with system (c).

It is also known upon the installation of a belt loop onto a frame to use a removable, short auxiliary support, shaped similarly to a C-shaped piece with the arms extending toward the main frame The belt loop is placed over the upper arm and the vertical stem of the C-shaped piece. The end of the auxiliary support is used to hold the frame part which holds the inner rolls, etc. which pass through the belt loop, during the removal of the intermediate pieces (Federal Republic of Germany Pat. No. 2,439,261). While this method does make a light weight auxiliary support possible, it has the disadvantage that the belt loop must be bent and be moved against gravity upon the drawing in. It would be conceivable to extend the upper arm of the known auxiliary support to such an extent that there is space for the entire width of the belt on it. In that case, however, the arm would have a very great unsupported length. Furthermore, since large masses, which the auxiliary support must temporarily support, rest on the frames of the paper making machine, such an auxiliary support would be very bulky, heavy and difficult to handle. A crane of particularly high capacity would have to be installed in order to move such an auxiliary support. The floor, which is the ceiling of the cellar alongside the machine, would have to be made particularly strong in order to prevent the auxiliary support from breaking through the floor solely by its own weight. For these reasons, this system has not been used, and was not even been considered, for two-belt loops arranged one over the other.

SUMMARY OF THE INVENTION

It is the object of the invention to develop a belt loop draw-in device in such a manner that its weight can be decisively reduced, and such that it is less bulky, heavy and difficult to handle.

The invention is adapted to be used with a paper making machine, cardboard making machine, or the like. That machine has a frame with a draw-in side onto, over and past which the belt is drawn in. The frame extends to an opposite side toward which the belt is moved as it is drawn in. The rolls for the belt are supported at the frame between the frame sides. At the draw-in side of the frame, the support is changeable, e.g., changeable in shape, for providing an open region along the height of the support through which at least the lower run of the endless belt may be drawn in over the frame. Were the shape of the frame at the draw-in side not thus changeable, the belt would be blocked from being drawn in. In the illustrated embodiment, that frame changeability is achieved through the provision of removable intermediate pieces at the draw-in side of the frame, and the temporary removal of those pieces enables the belt to be drawn in past the frame. Removal of the intermediate pieces is not possible until the weight on the draw-in side of the frame is temporarily lifted and supported. To provide the open regions, to permit removal of the intermediate pieces which opens the support on that side, an auxiliary support is provided.

The present invention primarily modifies the prior art by providing at least one and sometimes a plurality of extensions from the frame each in the form of a cantilever piece which extends beyond the draw-in side of the frame support for the rolls in the direction toward the auxiliary support. This has the effect of lengthening the lever arm of the frame, so that less force may be needed to raise the frame at the draw-in side.

The auxiliary support has cantilever arms, each of which support a respective cantilever piece extending from the frame. The cooperation between the cantilever arms of the auxiliary support and the corresponding cantilevered pieces of the frame supports the frame at the draw-in side so that the intermediate pieces can be removed and so that the belt can be drawn in past the draw-in side of the frame. The extension of the frame toward the auxiliary support permits a generally corresponding reduction in the length of the cantilever arms of the auxiliary support. The auxiliary support should be sufficiently wide to support the belt loop before it is drawn in over the frame. But with extension of the cantilever piece off the frame toward the auxiliary support, the auxiliary support can be narrowed and nonetheless provide an adequate width support for the belt loop to be drawn in.

There are lift devices disposed between each cantilever arm of the auxiliary support and the respective cantilever piece of the frame so that once the cantilever arm and cantilever piece are in position with respect to each other, the lift devices may raise the cantilever piece and relieve the weight on the support of the frame at the draw-in side enabling removal of the intermediate pieces.

The frame itself may be adapted to have a single, endless belt or, as is typical in twin wire or twin felt arrangements in a paper making machine, there may be two belt loops arranged one below and one above. Where the respective section of the paper making machine is a single belt section on the machine frame, the auxiliary support may have a generally C shape. The upper arm of the C defines the cantilever arm of the auxiliary support which cooperates with the cantilever piece of the frame. The auxiliary support is there C-shaped to provide space between the two arms of the C for the lower run of the belt while it is carried on the auxiliary support. Where the respective section of the paper making machine is a two belt section, the auxiliary support may have a generally E shape, with the middle arm of the E defining the cantilever arm for the cantilever piece for the lower belt and the top arm of the E defining the other cantilever arm for the cantilever piece for the top belt.

The following is achieved. For simplifying this explanation, it is assumed that the removable auxiliary support is preferably of substantially C-shape or E-shape, as seen in a cross-section through the machine.

After the opening, i.e., after the removal of intermediate pieces on the drawing in side, the machine frame has, or at least remotely resembles, the shape of a C or an E, again as seen in cross-section through the machine. In this case, however, the two structures, that is the main frame and the auxiliary support, are arranged as mirror images to each other so that the substantially horizontal, protruding parts of these two structures have their free ends directed toward each other. The concept of the invention lies in somewhat lengthening the freely protruding horizontal parts or girders or beams of the frame by cantilever pieces or "stub girders" and, on the other hand, in correspondingly shortening the horizontally freely protruding arm or the horizontally freely projecting arms of the auxiliary support of the drawing-in device. This has a twofold effect. On the one hand, with the lengthening of the horizontal girder of the machine frame, the lever arm on which the support must act is lengthened. Accordingly, the supporting force provided to the horizontal girder by the cantilever arm of the auxiliary support can be made smaller. On the other hand, the horizontal cantilever arm or the horizontal supporting cantilever arms of the auxiliary support are shorter. In this way, also the lever arm acting on the auxiliary support becomes correspondingly smaller. As a result, once again, the supporting forces for those cantilever arms can be reduced. In addition, there is also a reduction in the weight of the auxiliary support itself through its being shortened in overall width.

It is thus not only possible to make a, for instance, C-shaped auxiliary support be sufficiently light in weight, but it is even possible to develop a drawing-in device for two-belt loops lying one above the other, and having an E-shaped auxiliary support, nonetheless be of reasonable weight. This is true even for the very largest paper making machines. As compared with the known systems, all bending moments and thus all girder cross-sections and girder weights, and not only those of the auxiliary support, can be made substantially smaller. In addition to simplifying and permitting more rapid changing of the belt loops, a substantial reduction in expense of the machine can also be obtained.

It is therefore essential that the required length of the cantilever arms be divided over the cantilever arm of the auxiliary support and the cantilever piece or stub girder which extends out of the machine frame toward the auxiliary support.

Due to the relatively short cantilever length of the stub girder, the bending moment on the stub girder is also correspondingly small, so that this girder, and possibly its lengthening up to the other side of the frame, can be developed with a comparatively small cross-section, as compared with the conventional systems.

One could be satisfied with this reduction in weight in itself. But, in accordance with another embodiment of the invention, there is the possibility of drastically further reducing the size and weight of the auxiliary girder. At least one lifting device is temporarily placed within the machine frame in order to lift the drawing-in side of the machine frame before removal of the intermediate piece or pieces from the frame, via transverse girders, for the drawing in of the belt loop. If the distance of the lifting device from the middle of the "drawing-in side" of the frame is Y, then the necessary cantilever length of the auxiliary support mentioned is decreased by the amount Y and its weight is accordingly further reduced.

In one example, which has been calculated mathematically, the weight of the auxiliary support is only one quarter of the weight of a theoretical auxiliary support which has a cantilever arm with a length equal to the width of the belt.

Other objects and features of the present invention will become apparent from the following description of preferred embodiments of the invention considered in conjunction with the accompanying drawings.

DESCRIPTION OF THE PREFERRED EMBODIMENTS

Figure 1:
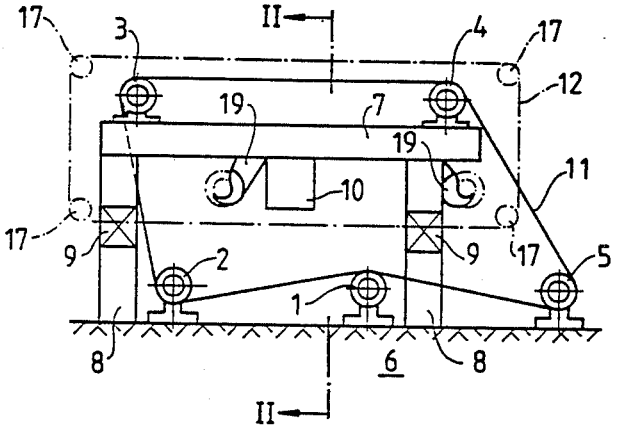
FIG. 1 is a view of a lateral belt travel end of a paper making machine.
Figure 2:
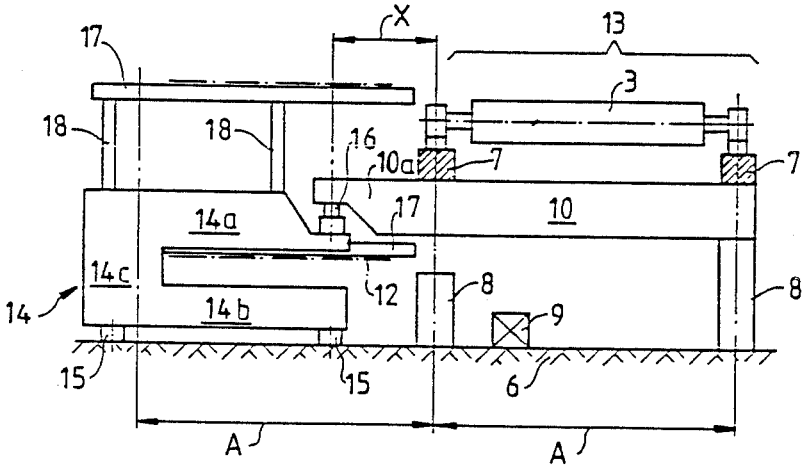
FIG. 2 shows this same belt travel end, viewed in cross-section along the plane II—II of FIG. 1.

In FIGS. 1 and 2, rolls 1 to 5 are rotatably fastened, in part on the floor 6 and in part of longitudinal, horizontal girders or beams 7 of the frame. The longitudinal girders 7 rest on legs 8 which are also parts of the frame. As shown in FIG. 1 and for the girder on one side, e.g. those to the left in FIG. 2, removable intermediate pieces 9 are disposed in the legs. Generally, they may be described as removable parts of the drawing-in side of the frame to enable belt loop installation. In FIG. 1, the intermediate pieces 9 are shown as normally inserted in the legs 8, while the intermediate pieces 9 are shown already removed in FIG. 2, which shows the legs readied for the changing of the belt. The intermediate pieces have been temporarily placed on the floor. A transverse horizontal girder or beam 10 connects the two longitudinal girders or beams 7.

A belt loop 11 to be replaced wraps around the rolls 1 to 5. During changes of the belt, the used belt 11 is generally cut apart and pulled out laterally. The rolls 2 and 5 are thereafter temporarily detached from the floor and raised and suspended from auxiliary brackets 19 above the intermediate pieces 9 during the drawing in of the new belt loop 12. Belt loop 12 is shown in phantom or broken lines in FIGS. 1 and 2. The rolls 3 and 4 are already usually supported on the girders. In this way, all inner rolls 2 to 5 are fastened to the girders 7 and 10 above the intermediate pieces 9 so that they cannot interfere with belt installation. After removal of these intermediate pieces 9, the new endless belt loop 12 can be introduced from the left, draw-in side in FIG. 2, over the longitudinal girder 7 arranged at the left in FIG. 2, and over all of the inner rolls 2 to 5. After reinsertion of the intermediate pieces 9 into the receiving gaps of their legs 8, the rolls 2 to 5 are again lowered into their operating positions. The new belt loop 12 assumes the same travel path as the old belt loop 11. One or more of the rolls 1 to 5 as shown can also be developed displaceably or swingably as a tensioning or adjusting roll.

In FIG. 2, to the left and alongside the machine 13, there is a C-shaped in cross-section, removable, auxiliary support 14, which rests via feet 15 on the floor 6. The transverse girder 10 of the machine 13 is long enough to have a cantilever extension piece 10*a*, also referred to as a "stub girder". This comprises an extension of the length X extending beyond the machine frame in the direction toward the auxiliary support 14. A hydraulic lift 16 at the free end of the upper cantilever arm 14*a* of the auxiliary support 14 supports the transverse girder 10 at a distance X from the left longitudinal girder 7. The distance between the longitudinal girders 7, which is equal to the width of the machine frame, is A. The distance of the vertical part 14*c* or web of the C-shaped auxiliary support 14 from the left longitudinal girder 7 is also equal approximately to A. Thus, the cantilever length of the cantilever arm 14*a* up to the lift 16 is approximately A-X. This cantilever length is necessary in order that the belt loop 12 which has been previously draped over support rods 17 can be pulled out to its full width, namely ungathered.

There are horizontal support rods 17 for the belt loop on the auxiliary support. The belt loop 12 can be at least partially stretched out upon the support rods 17. The length of the support rods 17 is somewhat greater than A. These rods are in turn supported by and fastened by supports 18 to the auxiliary support 14.

The ratio X/A, of the length of the cantilever piece to the width of the machine frame, is preferably equal to between 0.2 and 0.4. In this way, both the weight of the auxiliary support 14 and the bending moment of the cantilever piece 10*a* are relatively small. As a result, optimal economy of material can be obtained.

Figure 3:
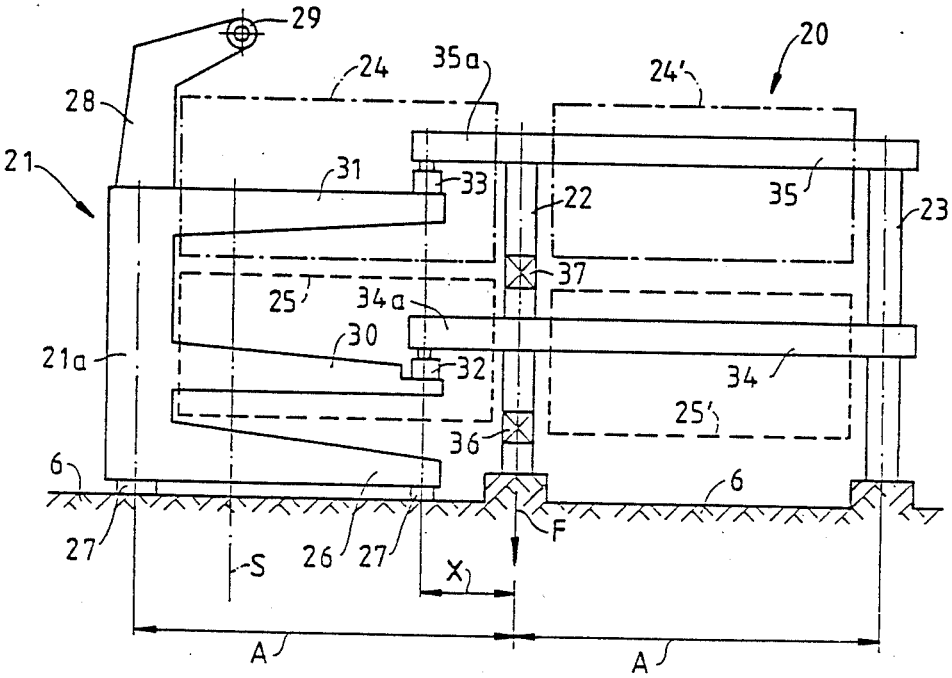
FIG. 3 is a simplified schematic showing two belt travel end frames arranged one above the other, and also seen in cross-section. Rolls and possible longitudinal girders, etc., have been omitted for clarity of the drawing.

FIG. 3 shows a two-level belt travel end 20 with an E-shaped cross-section auxiliary support 21 as a belt draw-in device instead of the C-shaped auxiliary support 14 of a single level belt travel end. In order to improve the clarity of the drawing FIG. 3, the rolls, which are fastened to the frame parts 22 and 23 and lie horizontally between the frame parts 22, 23, have not been shown. Further, the support rods 17 and supports 18 which hold the predraped belt loops 24 and 25 on the auxiliary support 21 have not been shown.

The lower arm 26 of the E-shaped auxiliary support 21 stands on the floor through feet 27. An upstanding arm 28 with an eye 29 at its top serves as means for the attachment of the crane. The eye 29 lies in or close to the vertical centroidal axis "S" of the auxiliary support 21. The middle arm 30 is for supporting the cantilever piece 34*a*. The top arm 31 is for supporting the cantilever piece 35*a*. All three horizontal arms 26, 30, 31 and the vertical part 21*a* of the E-shaped auxiliary support 21 are developed in light weight construction as rectangular, boxlike, hollow profiles with corresponding stiffenings at their critical points. At the right-hand or free ends of the arms 30 and 31, there are hydraulic lifts 32 and 33. By means of these lifts, the extending cantilever pieces 34*a*, 35*a* of the transverse girders 34 and 35 are lifted by the respective lifts 32, 33 so that the drawing-in side of the frame is supported which enables the intermediate pieces 36 and 37 to be removed.

Once the intermediate pieces 36 and 37 have been removed, the belt loops 24 and 25 can be pushed into their respective operating positions 24' and 25' between the frame parts 22 and 23. The intermediate pieces 36, 37 are then reinserted, the hydraulic lifts 32, 33 are relieved of load, and the auxiliary support 21 is conveyed by the boom crane (not shown) into its position of rest, where the next two belt loops are predraped onto the support 21.

Figure 4:
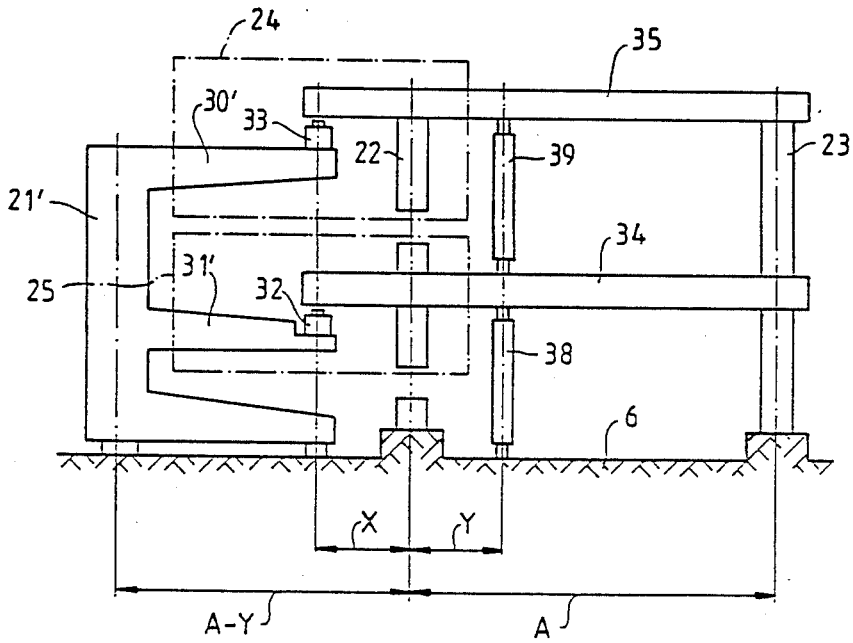
FIG. 4 shows a variant of the embodiment of FIG. 3.

FIG. 4 shows still another embodiment. In this case, additional lift devices 38 and 39 are placed at a distance Y from the center of the one frame part 22 on the drawing-in side between the floor 6 and the lower transverse girder 34, as well as between the lower and upper transverse girders 34 and 35. The lift devices 38, 39 are typically hydraulic devices, or jacks, or the like. Lift devices 38, 39 lift the transverse girders 34 and 35 even before the connection of the E-shaped auxiliary support 21', whereupon the intermediate pieces 36 and 37 are taken out. In this variant, the belt loops 24 and 25 can protrude further to the right and off the edge of the auxiliary support than in the embodiment of FIG. 3 by the distance Y beyond the ends of the legs 30' and 31', even before the connection of the auxiliary support 21, by means of the hydraulic lifts 32, 35, to the transverse girders 34 and 35. In this way, the cantilever length of the arms 30' and 31' can be shortened by this amount, as compared with Fi. 3. In this variant, there is thus obtained an additionally shortened and very particularly light auxiliary support 21'.

In FIG. 4, the lift devices 38 and 39 are each respectively so controlled by known means that their lift forces vary approximately proportionately to each other between zero and a maximum force.

Figure 5:
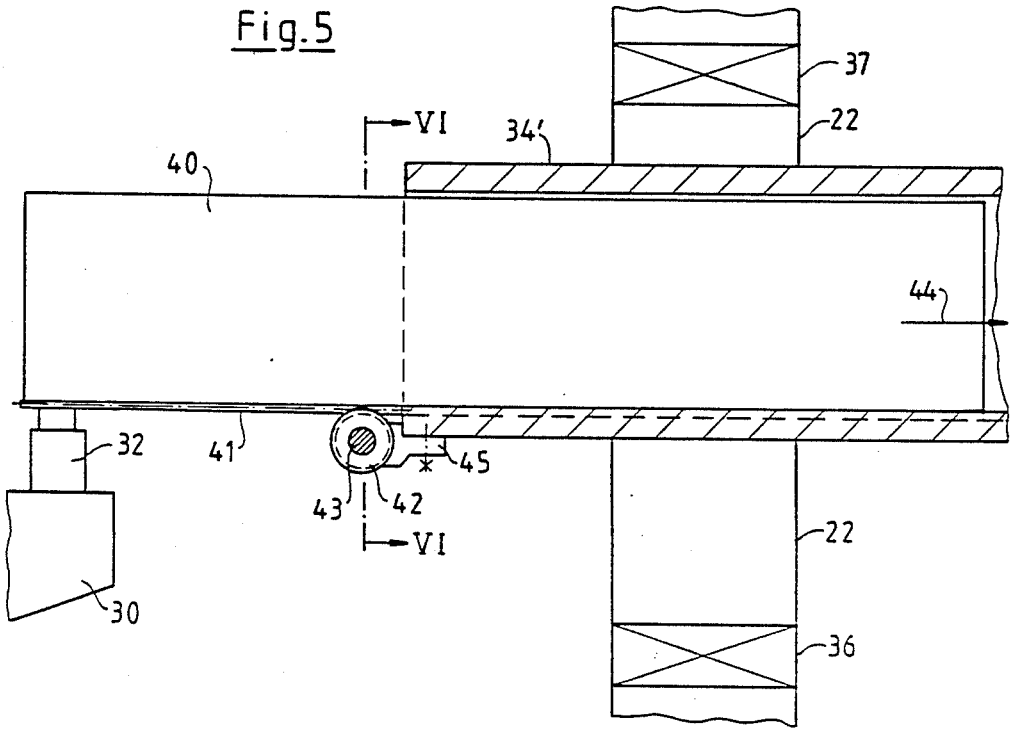
FIG. 5 shows a modified detail of FIG. 3 in section along the line V—V of FIG. 6.
Figure 6:
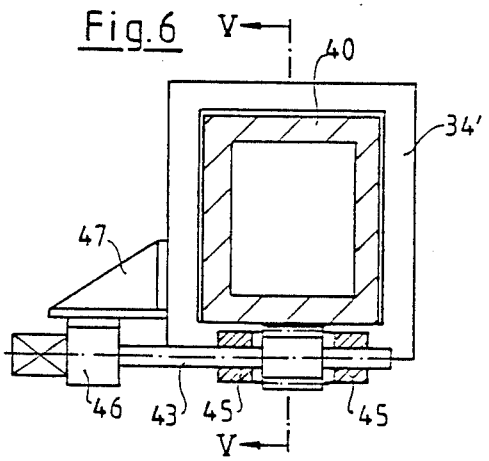
FIG. 6 is a section along the line VI—VI of FIG. 5.

It is assumed by way of example in FIG. 2 that the cantilever piece 10*a* is a fixed part of the transverse girder 10 and that it thus extends permanently laterally out of the paper machine. This may be undesirable in certain cases, possibly because operation of the machine is made difficult. FIGS. 5 and 6 show one possible way of avoiding this disadvantage.

In FIG. 5, similar to FIG. 3, one sees the drawing-in side frame parts 22 with the removable intermediate pieces 36 and 37 and the end of the cantilever arm 30 of the auxiliary support (21 in FIG. 3) with the respective hydraulic lift 32. A differently designed transverse girder or beam 34' is developed as a hollow girder which is open at one end. The cantilever piece 40 is now a separate part from and is arranged telescopically within the transverse girder 34'. The piece 40 extends in FIG. 5 up to the hydraulic lift 32 for the drawing in of a belt loop. After the conclusion of each drawing-in process, the cantilever piece 40 can be moved inward telescopically, in the direction of the arrow 44, inside the transverse girder 34'. For this purpose, a rack 41 is provided on the bottom of the cantilever piece 40. It is engaged by a gear 42 which is fastened on a shaft 43 and is rotatably mounted in bearings 45. The shaft 43 and the gear 42 can be driven either by hand or by means of a gear motor 46 which is fastened to a bracket 47. The bearings 45 and the bracket 47 are fastened to the transverse girder 34'.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A device for enabling the drawing in of an endless belt into a machine, comprising:

a frame for the machine, the machine frame having a draw-in side onto and over and past which the belt is drawn in and an opposite side toward which the belt is moved as the belt is drawn in;

a plurality of rolls supported at the frame between the slides of the frame over which the endless belt travels;

at the draw-in side of the frame, a support for the frame; and the frame having a roll supporting part which is supported on the frame support; the frame support being changeable for providing an open region along the height of the frame support through which the endless belt may be drawn in over the frame;

the frame having at least one cantilever piece which extends beyond the frame support at the draw-in side and extends beyond the draw-in side of the frame for a first distance;

an auxiliary support located at the draw-in aide of the frame and being relatively moveable with respect to the frame; the auxiliary support including means for supporting the belt that is to be drawn-in off the auxiliary support and onto the frame between the sides of the frame; the auxiliary support further comprising a cantilever arm having a free end that extends toward the draw-in side of the machine frame for a second distance; the length of the cantilever arm of the auxiliary support and the length of the cantilever piece of the frame are respectively selected such that with the auxiliary support placed at the draw-in side of the frame, the cantilever arm of the auxiliary support is positioned for and includes means for providing support to the cantilever piece of the frame during the draw-in of the belt off the auxiliary support onto the frame; the auxiliary support being emplaceable next to the draw-in side of the frame for the cantilever arm to provide support to the cantilever piece and being removable away from the draw-in of the frame;

the device being dimensioned such that the sum of the first and second distances approximates the length of the width of the frame between the sides thereof.

2. The device for drawing in a belt of claim 1, wherein the frame support being changeable comprises an intermediate piece defined in the frame support and temporarily removable therefrom for providing the open region in the frame support.

3. The device for drawing in a belt of claim 1, wherein the auxiliary support has at least approximately a C-shape, with one leg of the C defining the bottom of the auxiliary support for supporting the auxiliary support and the other leg of the C having on it and defining the cantilever arm which extends toward the cantilever piece of the frame.

4. The device for drawing in a belt of claim 3, wherein the device for supporting the belt loop at the auxiliary support in part comprises a space defined between the legs of the C-shaped piece and the space having a shape for the endless belt to pass through while the belt loop is on the auxiliary support.

5. The device for drawing in a belt of claim 1, wherein the frame includes a girder extending across the frame between the sides thereof and extending beyond the draw-in side of the frame and defining thereon the cantilever piece.

6. The device for drawing in a belt of claim 1, further comprising a separate second set of rolls on the frame for supporting a second endless belt above the first mentioned endless belt;

the frame having a respective one of the cantilever pieces for each belt, one cantilever piece above the other;

the auxiliary support including means for supporting both of the endless belts; the auxiliary support having a lower cantilever arm for the lower one of the cantilever pieces and an upper cantilever arm for the upper one of the cantilever pieces, and each cantilever arm including means for providing support to the respective cantilever piece when the auxiliary support is located at the draw-in side of the frame.

7. The device for drawing in a belt of claim 6, wherein the auxiliary support has at least approximately an E-shape, with a bottom leg of the E defining the bottom of the auxiliary support for supporting the auxiliary support, a middle leg of the E having on it and defining the cantilever arm which extends toward the lower cantilever piece and an upper leg of the E having on it and defining the cantilever arm which extends toward the upper cantilever piece.

8. The device for drawing in a belt of claim 1, wherein said means for providing support to the cantilever piece comprises a lift device generally at the free end of the cantilever arm and disposed between the cantilever arm and the cantilever piece of the machine frame, the lift device being operable for providing lift to the respective cantilever piece.

9. The device for drawing in a belt of claim 6, wherein said means for providing support to the cantilever piece comprises a lift device provided generally at the free end of each cantilever arm and disposed between each cantilever arm and the respective cantilever piece of the machine frame, the lift device being operable for providing lift to the respective cantiliver piece.

10. The device for drawing in a belt of claim 1, further comprising a lift device disposed between the sides of the machine frame and located to provide support to the machine frame as the lift device is operated to provide lift, the lift device being placed for providing lift to the frame toward the draw-in side thereof and also to the cantilever piece from the frame.

11. The device for drawing in a belt of claim 6, further comprising a lower lift device located between the sides of the frame and extending into engagement with the frame for providing lift to the lower cantilever piece and an upper lift device located between the sides of the frame and connected between the frame and the part of the frame supporting the upper cantilever piece for providing support to the upper cantilever piece.

12. The device for drawing in a belt of claim 1, wherein the means on the auxiliary support for supporting the endless belt comprises support bars supported on the auxiliary support and movable with respect to the auxiliary support for at least partially stretching out the belt loop before it is drawn-in onto the frame.

13. The device for drawing in a belt of claim 1, wherein beyond the draw-in side of the frame the ratio of the length of the cantilever piece to the length of the width of the frame is between 0.2 and 0.4.

14. The device for drawing in a belt of claim 1, wherein the cantilever piece is supported to the frame and is movable into the frame in a direction toward the opposite side of the frame from the draw-in side, and is movable out of the frame in the direction of the auxiliary support for cooperation with the auxiliary support during the draw-in of the belt.

15. The device for drawing in a belt of claim 1, further comprising:

the frame support supporting the frame on a surface; at the draw-in side of the frame, the frame support comprises a plurality of upstanding legs which rest on the surface; the frame roll-supporting part for the rolls is upraised off the surface by the legs;

the frame support being changeable comprises an intermediate piece defined in each leg and temporarily removable therefrom for providing the open region through which the endless belt may be moved as the belt is drawn in over the frame.

16. The device for drawing in a belt of claim 1, wherein the frame comprises a girder extending from the opposite side of the frame to the draw-in side of the frame and then extending beyond the draw-in side of the fame for there defining the cantilever piece; the cantilever arm supporting the cantilever piece and thereby also supporting the girder; the girder having one end portion supported at the cantilever arm and the girder having another end portion supported on the opposite side of the machine frame when the girder is not being supported at the draw-in side of the machine frame by the frame support at the draw-in side of the machine frame.

17. The device for drawing in a belt of claim 16, further comprising a lift device between the sides of the frame and located to provide support to the girder as the lift device is operated to provide lift to the girder; the lift device being placed for providing lift to the girder toward the draw-in side of the frame, thereby also to provide lift to the cantilever piece.

* * * * *